US010100821B2

(12) United States Patent
Yatsu

(10) Patent No.: US 10,100,821 B2
(45) Date of Patent: Oct. 16, 2018

(54) COLD TRAP AND CONTROL METHOD OF COLD TRAP

(71) Applicant: Sumitomo Heavy Industries, Ltd., Tokyo (JP)

(72) Inventor: Takahiro Yatsu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 197 days.

(21) Appl. No.: 14/971,746

(22) Filed: Dec. 16, 2015

(65) Prior Publication Data

US 2016/0177935 A1 Jun. 23, 2016

(30) Foreign Application Priority Data

Dec. 17, 2014 (JP) ..... 2014-255029

(51) Int. Cl.
*B01D 8/00* (2006.01)
*F04B 37/08* (2006.01)

(52) U.S. Cl.
CPC ..... *F04B 37/08* (2013.01)

(58) Field of Classification Search
CPC ..... F04B 37/08; F04B 49/00
See application file for complete search history.

(56) References Cited

U.S. PATENT DOCUMENTS

| | | | | |
|---|---|---|---|---|
| 8,336,318 | B2 | 12/2012 | Koyama | |
| 8,800,303 | B2 | 8/2014 | Oikawa | |
| 2009/0266088 | A1* | 10/2009 | Oikawa | B01D 8/00 62/55.5 |
| 2011/0016890 | A1 | 1/2011 | Kimura | |
| 2013/0219924 | A1 | 8/2013 | Fukuda | |

FOREIGN PATENT DOCUMENTS

| | | | |
|---|---|---|---|
| JP | 2009-262083 | A | 11/2009 |
| JP | 2009-275579 | A | 11/2009 |
| JP | 2011-026985 | A | 2/2011 |
| JP | 2013-170568 | A | 9/2013 |

* cited by examiner

*Primary Examiner* — Ana Vazquez
(74) *Attorney, Agent, or Firm* — Michael Best & Friedrich LLP

(57) ABSTRACT

A cold trap includes a cold panel, a cryocooler which cools the cold panel, a stage temperature control unit which determines a control input to the cryocooler to cool a cooling stage of the cryocooler to a target temperature, an input heat estimation unit which estimates an increase of input heat into the cold panel based on the control input to the cryocooler determined by the stage temperature control unit, and a target temperature adjustment unit which adjusts a target temperature based on the increase of the input heat estimated by the input heat estimation unit.

4 Claims, 6 Drawing Sheets

COLD TRAP AND CONTROL METHOD OF COLD TRAP

RELATED APPLICATIONS

Priority is claimed to Japanese Patent Application No. 2014-255029, filed Dec. 17, 2014, the entire content of which is incorporated herein by reference.

BACKGROUND

Technical Field

Certain embodiments of the invention relate to a cold trap and a control method of a cold trap.

Description of Related Art

A cold trap is a device for evacuating a vacuum vessel, and includes a cold panel and a cryocooler which cools the cold panel. A gas having a high boiling point such as water vapor is condensed on a surface of the cold panel, and is removed from the vacuum vessel. The cold panel is cooled so as to reach a temperature at which a vapor pressure of the discharged gas sufficiently decreases. Other gases are discharged through a main vacuum pump such as a turbomolecular pump provided in the vacuum vessel.

SUMMARY

According to an embodiment of the present invention, there is provided a cold trap which h evacuates a vacuum vessel having a main vacuum pump. The cold trap includes a cold panel which is disposed inside an exhaust duct which connects the vacuum vessel to the main vacuum pump or is disposed inside the vacuum vessel; a single-stage cryocooler which includes a cooling stage which is structurally connected to the cold panel and is thermally coupled to the cold panel; a stage temperature control unit which determines a control input to the single-stage cryocooler so as to cool the cooling stage to a target temperature; an input heat estimation unit which estimates an increase of the input heat into the cold panel based on the control input with respect to the single-stage cryocooler determined by the stage temperature control unit; and a target temperature adjustment unit which decreases the target temperature based on the increase of the input heat estimated by the input heat estimation unit.

According to another embodiment of the present invention, there is provided a control method of a cold trap for evacuating a vacuum vessel having a main vacuum pump. The cold trap includes a coldpanel which is disposed inside an exhaust duct which connects the vacuum vessel to the main vacuum pump or is disposed inside the vacuum vessel, and a single-stage cryocooler which includes a cooling stage which is structurally connected to the cold panel and is thermally coupled to the cold panel. The method includes determining a control input to the single-stage cryocooler so as to cool the cooling stage to a target temperature; estimating an increase of the input heat into the cold panel from the determined control input to the single-stage cryocooler; and decreasing the target temperature based on the estimated increase of the input heat.

DETAILED DESCRIPTION

Figure 1:
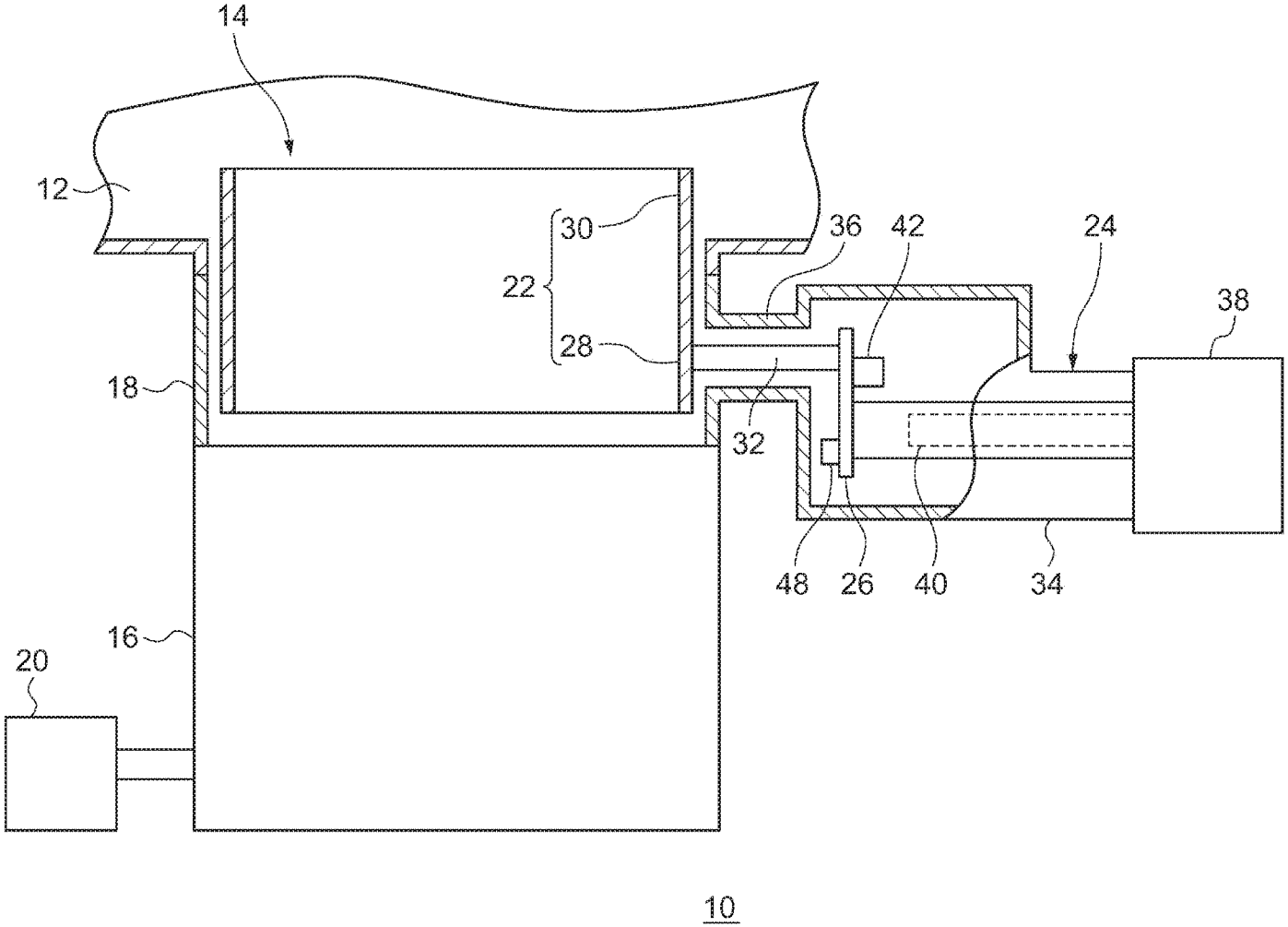
FIG. 1 is a sectional view schematically showing a vacuum exhaust device according to an embodiment of the present invention.

According to a shape or a disposition of a cold panel, or a surrounding environment, an undesirable and relatively high temperature difference may occur between a portion and other portions of the cold panel. For example, when thermal conductivity of a connection structure by which the cold panel is connected to a cryocooler is small, or when heat input from a vacuum vessel into the cold panel increases, a temperature of the end of the cold panel which is far from a connection point between the cold panel and the cryocooler is significantly higher than a temperature of the connection point.

It is desirable to provide a cold trap capable of appropriately cooling a cold panel and a control method thereof.

In addition, aspects of the present invention include arbitrary combinations of the above-described components, or components or representations of the present invention which are replaced by each other among a device, a method, a system, a computer program, a recording medium storing a computer program, or the like.

According to embodiments of the present invention, it is possible to provide a cold trap capable of appropriately cooling a cold panel, and a control method thereof.

Hereinafter, aspects for embodying the embodiments of the present invention will be described in detail with reference to the drawings. In addition, in descriptions, the same reference numerals are assigned to the same elements, and overlapping descriptions are appropriately omitted. Moreover, configurations described below are only examples, and scopes of embodiments of the present invention are not limited by the configurations.

FIG. 1 is a sectional view schematically showing a vacuum exhaust device 10 according to an embodiment of the present invention. The vacuum exhaust device 10 is configured so as to evacuate a vacuum vessel 12. The vacuum vessel 12 is a vacuum processing chamber of a vacuum processing device. The vacuum processing device is configured so as to perform predetermined processing on a surface of an object to be processed (for example, a semiconductor wafer) in the vacuum processing chamber.

The vacuum exhaust device 10 includes a cold trap 14 and a main vacuum pump 16. The cold trap 14 is installed in the vacuum vessel 12 so as to discharge gas having a high boiling point such as water vapor from the vacuum vessel 12. The cold trap 14 is an in-line type cold trap which is disposed between the vacuum vessel 12 and the main vacuum pump 16. The main vacuum pump 16 is installed in the vacuum vessel 12 so as to discharge other gases such as argon or nitrogen from the vacuum vessel 12.

The main vacuum pump 16 is a high vacuum pump for discharging air until the vacuum vessel 12 reaches a high vacuum region. For example, the main vacuum pump 16 is a turbo-molecular pump.

The main vacuum pump 16 is connected to the vacuum vessel 12 via an exhaust duct 18. The exhaust duct 18 is an exhaust flow path through which gas flows from vacuum vessel 12 to the main vacuum pump 16. An exhaust port of the vacuum vessel 12 is connected to an intake port of the main vacuum pump 16 by the exhaust duct 18.

The vacuum exhaust device 10 includes an auxiliary pump 20 by which air inside the vacuum vessel 12 is discharged until the main vacuum pump 16 reaches an operating pressure. The auxiliary pump 20 is an approximate vacuum pump which performs approximate evacuation of the vacuum vessel 12. The auxiliary pump 20 is connected to an exhaust port of the main vacuum pump 16.

The cold trap 14 includes a cold panel 22 which is disposed inside the vacuum vessel 12 and the exhaust duct 18, and a cryocooler 24 for cooling the cold panel 22. The entire cold panel 22 is exposed to the exhaust duct 18 and the vacuum vessel 12.

The cryocooler 24 is a single-stage cryocooler, and includes a single cooling stage 26. The cooling stage 26 is disposed on a low-temperature end of the cryocooler 24. The cooling stage 26 is structurally connected to the cold panel 22 and is thermally coupled to the cold panel 22. The cryocooler 24 is accommodated in a cryocooler housing 34.

The cryocooler 24 is configured to periodically change each of a pressure and a volume of an operating gas at a different phase according to a thermal cycle. For example, the thermal cycle is a Gifford-McMahon cycle. For example, the operating gas is helium. The cryocooler 24 is connected to a compressor (not shown) which supplies a high-pressure operating gas to the cryocooler 24. The operating gas supplied to the cryocooler 24 is decompressed by adiabatic expansion. Accordingly, the cooling stage 26 is cooled. A low-pressure operating gas is collected by the compressor, is compressed, and is supplied to the cryocooler 24 again.

The cryocooler 24 includes a cryocooler motor 38 which drives the cryocooler 24 and a drive mechanism 40 which is driven by the cryocooler motor 38. The cryocooler motor 38 is disposed on a high-temperature end of the cryocooler 24.

Figure 2:
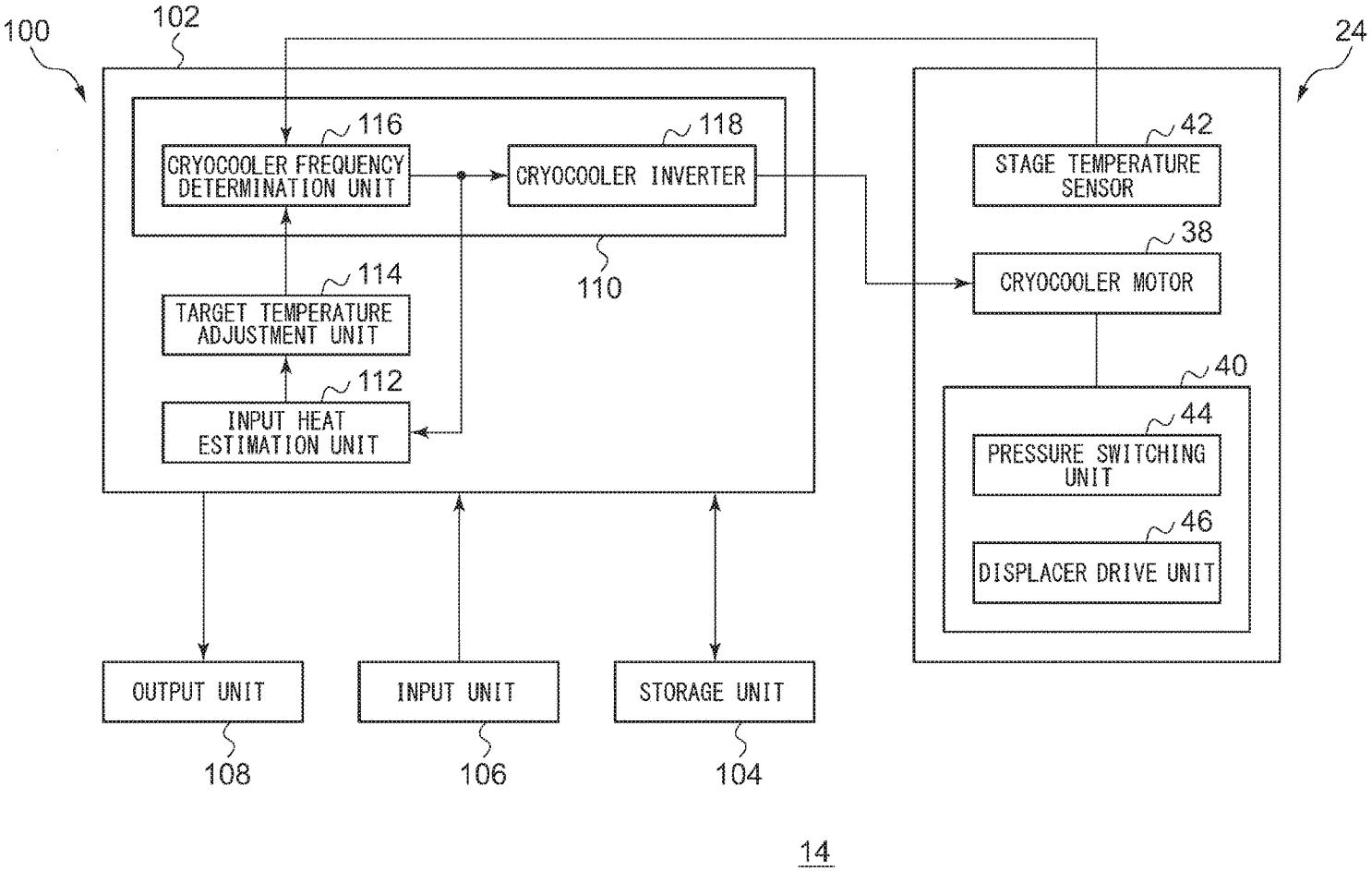
FIG. 2 is a view schematically showing a configuration of a controller of a cold trap according to the embodiment of the present invention.

As shown in FIG. 2, the drive mechanism 40 includes a pressure switching unit 44 which is configured to switch between supply of a high-pressure operating gas to the cryocooler 24 and discharge of a low-pressure operating gas from the cryocooler 24. The pressure switching unit 44 includes a rotary valve which is rotated by the cryocooler motor 38. In addition, the drive mechanism 40 includes a displacer drive unit 46 which is configured to reciprocate a displacer (not shown) of the cryocooler 24 between the low-temperature end and the high-temperature end of the cryocooler 24. According to the movement of the displacer, a volume of an operating gas expansion chamber (not shown) of the low-temperature end of the cryocooler 24 is changed by the thermal cycle. The drive mechanism 40 is configured to drive the pressure switching unit 44 and the displacer drive unit 46 so that a pressure change and a volume change of the operating gas expansion chamber have a given phase difference.

As shown in FIGS. 1 and 2, the cryocooler 24 includes a stage temperature sensor 42 which measures the temperature of the cooling stage 26. The stage temperature sensor 42 is mounted on the cryocooler stage 26.

The cold panel 22 includes a first panel portion 28 and a second panel portion 30. The first panel portion 28 is disposed inside the exhaust duct 18. The first panel portion 28 is fixed to the cooling stage 26 via a heat transfer member 32. The first panel portion 28 may be directly fixed to the cooling stage 26. The second panel portion 30 extends from the first panel portion 28 and is disposed inside the vacuum vessel 12. The second panel portion 30 is thermally coupled to the cooling stage 26 via the first panel portion 28. The cold panel 22 is formed in tubular shape so as to surround a center axis of the exhaust duct 18.

The heat transfer member 32 is a rod-shaped member in which one end is connected to the cooling stage 26 and the other end is connected to the first panel portion 28 of the cold panel 22. The heat transfer member 32 is inserted into an opening portion 36 of the exhaust duct 18 and is accommodated therein. The opening portion 36 is a through hole which is formed in the exhaust duct 18 along a radial direction perpendicular to the center axis of the exhaust duct 18. The exhaust duct 18 is airtightly connected to the cryocooler housing 34 through the opening portion 36.

The cold trap 14 may include an attachment flange portion which forms at least a portion of the exhaust duct 18 and surrounds the cold panel 22. The attachment flange portion may include a first vacuum flange for attaching the cold trap 14 to the vacuum vessel 12 and/or a second vacuum flange for attaching the cold trap 14 to the main vacuum pump 16. The attachment flange portion may be provided so as to be adjacent to the cryocooler housing 34. The opening portion 36 may be formed on the attachment flange portion.

FIG. 2 is a view schematically showing a configuration of a controller 100 of the cold trap 14 according to an embodiment of the present invention. The controller is implemented by hardware, software, and a combination thereof. In addition, in FIG. 2, a configuration of a portion of the cryocooler 24 related to the controller 100 is schematically shown.

The controller 100 includes a cryocooler control unit 102, a storage unit 104, an input unit 106, and an output unit 108. Although the cryocooler control unit 102 will described in detail below, the cryocooler control unit 102 is configured to adjust a cooling capacity of the cryocooler 24 based on a change of input heat with respect to the cold panel 22.

The storage unit 104 is configured so as to store information related to the control of the cold trap 14. The input unit 106 is configured so as to receive input from a user or other devices. For example, the input unit 106 includes an input unit such as a mouse or a keyboard for receiving input from a user and/or a communication unit for communicating with other devices. The output unit 108 is configured so as to output information related to the control of the cold trap 14, and includes an output unit such as a display or a printer. Each of the storage unit 104, the input unit 106, and the output unit 108 is communicatively connected to the cryocooler control unit 102.

The cryocooler control unit 102 monitors at least one operation parameter of the cryocooler 24, and indirectly estimates a change of input heat with respect to the cold panel 22 from the operation parameter. The operation parameter is a parameter which indicates a state of the cryocooler 24 during operation. The operation parameter may be a parameter which determines the cooling capacity of the cryocooler 24. The cryocooler control unit 102 adjusts the operation parameter (that is, monitored operation parameter) based on the estimated change of the input heat so that the cold panel 22 is cooled so as to reach a temperature lower than a cold panel upper limit temperature.

For example, at least one monitored operation parameter includes the control input with respect to the cryocooler 24. The control input with respect to the cryocooler 24 indicates an operating frequency (also referred to as an operation speed) of the cryocooler 24. The operating frequency of the cryocooler 24 is the operating frequency or a rotating speed of the cryocooler motor 38, an operating frequency of an inverter which controls the operating frequency of the motor, a frequency of a thermal cycle, or a parameter indicating any one of these. The frequency of the thermal cycle is the number of times per unit time the thermal cycle is performed in the cryocooler 24.

The cold panel upper limit temperature is a temperature at which a vapor pressure of gas discharged by the cold trap 14 is sufficiently decreased. For example, the cold panel upper limit temperature is predetermined so as to be 130 K or a temperature less than 130 K. This temperature range is a temperature range within which the vapor pressure of the water vapor is $10^{-8}$ Pa or less.

The cryocooler control unit 102 includes a stage temperature control unit 110, an input heat estimation unit 112, and a target temperature adjustment unit 114. The stage temperature control unit 110 is configured to determine the control input with respect to the cryocooler 24 so that the cooling stage 26 is cooled so as to reach a target temperature. The input heat estimation unit 112 is configured to estimate an increase of the input heat with respect to the cold panel 22 from the control input with respect to the cryocooler 24 determined by the stage temperature control unit 110. The target temperature adjustment unit 114 is configured so as to decrease the target temperature of the cooling stage 26 based on the increase of the input heat estimated by the input heat estimation unit 112.

The stage temperature sensor 42 is connected to the cryocooler control unit 102 so as to output signals indicating a measured temperature of the cryocooler stage 26 to the cryocooler control unit 102. In addition, the cryocooler control unit 102 is communicatively connected to the cryocooler motor 38.

The stage temperature control unit 110 includes a cryocooler frequency determination unit 116 and a cryocooler inverter 118. The cryocooler frequency determination unit 116 is configured to determine the operating frequency of the cryocooler 24 (for example, by a PID control) which is a function of a deviation between the temperatures of the cooling stage 26 measured by the stage temperature sensor 42 and the target temperature. For example, when the measured temperature of the cooling stage 26 exceeds the target temperature, the cryocooler frequency determination unit 116 increases the operating frequency of the cryocooler 24, and when the measured temperature of the cooling stage 26 is lower than the target temperature, the cryocooler frequency determination unit 116 decreases the operating frequency of the cryocooler 24. In this way, the cooling stage 26 is cooled so as to reach the target temperature. The cryocooler frequency determination unit 116 outputs the determined operating frequency of the cryocooler 24 to the cryocooler inverter 118.

The cryocooler inverter 118 is configured so as to provide a variable frequency control of the cryocooler motor 38. The cryocooler inverter 118 converts input power into power having the operating frequency input from the cryocooler frequency determination unit 116. The input power with respect to the cryocooler inverter 118 is supplied from a cryocooler power source (not shown). The cryocooler inverter 118 outputs the converted power to the cryocooler motor 38. Accordingly, the cryocooler motor 38 is driven at the operating frequency output from the cryocooler inverter 118 determined by the cryocooler frequency determination unit 116.

The storage unit 104 stores a plurality of target stage temperatures input from the input unit 106. Each of the plurality of target stage temperatures is predetermined to cool the cold panel 22 such that it reaches a temperature lower than the cold panel upper limit temperature with different input heats with respect to the cold panel 22. The target stage temperature can be appropriately determined experimentally or empirically.

For example, the plurality of target stage temperatures include a first target stage temperature and a second target stage temperature. The first target stage temperature may be set to a target temperature which is generally used in the cryocooler control unit 102. The first target stage temperature is predetermined so that the cold panel 22 is cooled so as to reach the first panel temperature when the cold panel 22 receives first input heat. Similarly, the second target stage temperature is predetermined so that the cold panel 22 is cooled so as to reach the second panel temperature when the cold panel 22 receives second input heat. The second target stage temperature is lower than the first target stage temperature. For example, the first target stage temperature is 100 K, and the second target stage temperature is 90 K. The second input heat is greater than the first input heat. Both the first panel temperature and the second panel temperature are lower than the cold panel upper limit temperature. The second panel temperature may be equal to the first panel temperature, or may be different from the first panel temperature.

In addition the storage unit 104 stores a control input threshold value input from the input unit 106. The control input threshold value is a value of the control input corresponding to the cold panel upper limit temperature. The control input threshold value is predetermined based on a correlation between the control input and the temperature of the cold panel 22 generated when the cold panel 22 receives input heat in a case where a target temperature is selected by the target temperature adjustment unit 114. For example, the control input threshold value is predetermined based on a correlation between the control input and the temperature of the cold panel 22 generated when the cold panel 22 receives the second input heat in a case where the first target stage temperature is selected by the target temperature adjustment unit 114.

A temperature Tp[K] of the cold panel 22 is expressed by the following expression using a temperature Ts[K] of the cooling stage 26 when the cold panel 22 receives input heat P[W] from the outside (for example, vacuum vessel 12).

$$Tp=Ts+P/G$$

Here, thermal conductivity G[W/K] is a constant which is determined by a design of a heat transfer path through which the cold panel 22 is connected to the cooling stage 26. The thermal conductivity G is proportional to the thermal conductivity and a sectional area of the heat transfer member 32, and is inversely proportional to a length of the heat transfer member 32. The length of the heat transfer member 32 is a length in a heat flow direction from the cold panel 22 toward the cooling stage 26, and the sectional area of the heat transfer member 32 is an area of a section perpendicular to the heat flow direction. Accordingly, when the heat transfer member 32 is a rod-shaped member which is narrow and long, the thermal conductivity G is small.

When the temperature Ts of the cooling stage 26 is maintained at the first target stage temperature by the control of the stage temperature control unit 110, if the input heat P is equal to the first input heat (that is, the input heat designed to correspond to the first target stage temperature), the temperature Tp of the cold panel 22 is cooled so as to reach the first panel temperature. If the input heat P increases, since the temperature Ts of the cooling stage 26 is maintained at a constant temperature by the control of the stage temperature control unit 110, the temperature Tp of the cold panel 22 increases from the first panel temperature. An increase amount of the temperature Tp increases as the thermal conductivity G decreases. In addition, the control input with respect to the cryocooler 24 determined by the stage temperature control unit 110 is changed such that the temperature Ts of the cooling stage 26 is maintained at a constant temperature with respect to the input heat P.

Accordingly, in the case where the cooling stage 26 is cooled so as to reach a target temperature, when the cold panel 22 receives an input heat different from the input heat designed to corresponding to the target temperature, the control input of the cryocooler 24 is changed in correlation with the temperature of the cold panel 22. Therefore, it is possible to appropriately determine the control input threshold value corresponding to the cold panel upper limit temperature experimentally or empirically based on the correlation.

The input heat estimation unit 112 monitors the control input of the cryocooler 24. In a case where a target temperature is selected by the target temperature adjustment unit 114, when a magnitude relation between the control input and the control input threshold value is inverted, the input heat estimation unit 112 estimates an increase of the input heat with respect to the cold panel 22. The target temperature adjustment unit 114 adjusts the target temperature when the increase of the input heat with respect to the cold panel 22 is estimated.

For example, when the magnitude relation between the control input and the control input threshold value is inverted in the case where the first target stage temperature is selected, the input heat estimation unit 112 estimates the increase of the input heat with respect to the cold panel 22 from the first input heat to the second input heat. The target temperature adjustment unit 114 selects the second target stage temperature when the increase of the input heat with respect to the cold panel 22 is estimated. That is, the target temperature adjustment unit 114 switches the target temperature of the cooling stage 26 from the first target stage temperature to the second target stage temperature.

Figure 3:
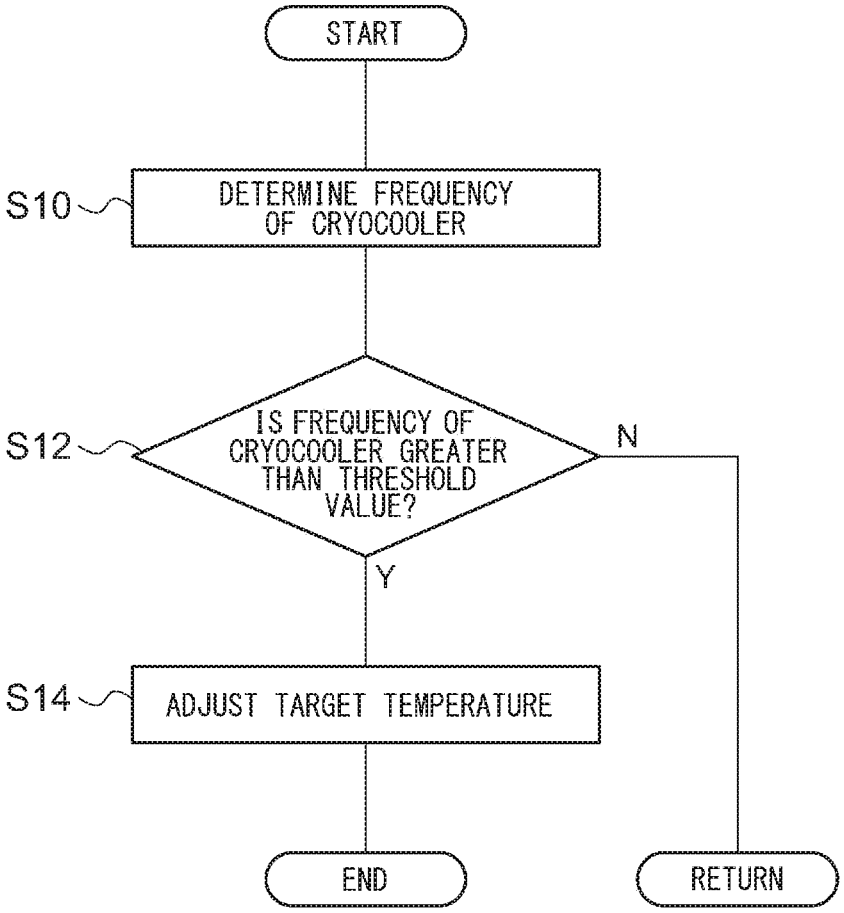
FIG. 3 is a flow chart showing a control method of a cold trap according to an embodiment of the present invention.

FIG. 3 is a flow chart showing a control method of a cold trap 14 according to an embodiment of the present invention. The cryocooler control unit 102 performs processing described below during an exhaust operation of the cold trap 14.

The stage temperature control unit 110 determines the operating frequency of the cryocooler 24 so that the cooling stage 26 is cooled so as to reach the first target stage temperature (S10). The input heat estimation unit 112 determines whether or not the determined operating frequency is greater than the operating frequency threshold value (S12). As described above, the operating frequency threshold value is predetermined based on the correlation between the operating frequency of the cryocooler 24 and the temperature of the cold panel 22 generated when the cold panel 22 receives the second input heat in the case where the first target stage temperature is selected.

When the determined operating frequency is smaller than the operating frequency threshold value (N in S12), the target temperature adjustment unit 114 maintains the target temperature at a current value. The target temperature adjustment unit 114 may output the target temperature to the output unit 108. In this way, when the target temperature is not changed, the cryocooler control unit 102 periodically repeats the present processing.

Meanwhile, when the determined operating frequency is greater than the operating frequency threshold value (Y in S12), the target temperature adjustment unit 114 selects the second target stage temperature (S14). In this way, the target temperature of the cooling stage 26 is decreased based on the increases of the input heat, and the present processing ends. The target temperature adjustment unit 114 may output the target temperature to the output unit 108. Thereafter, the cryocooler control unit 102 controls the cryocooler 24 so that the cooling stage 26 is cooled so as to reach the second target stage temperature.

An operation of the cold trap 14 configured as described above will be described. In the cryocooler 24, the cryocooler motor 38 and the drive mechanism 40 are driven at the operating frequency determined by the stage temperature control unit 110. The thermal cycle is repeated at the frequency corresponding to the operating frequency, and the cooling stage 26 is cooled so as to reach the first target stage temperature. In addition, the cold panel 22 is cooled so as to reach the first panel temperature. Accordingly, water vapor is trapped on the surface of the cold panel 22.

Figure 4:
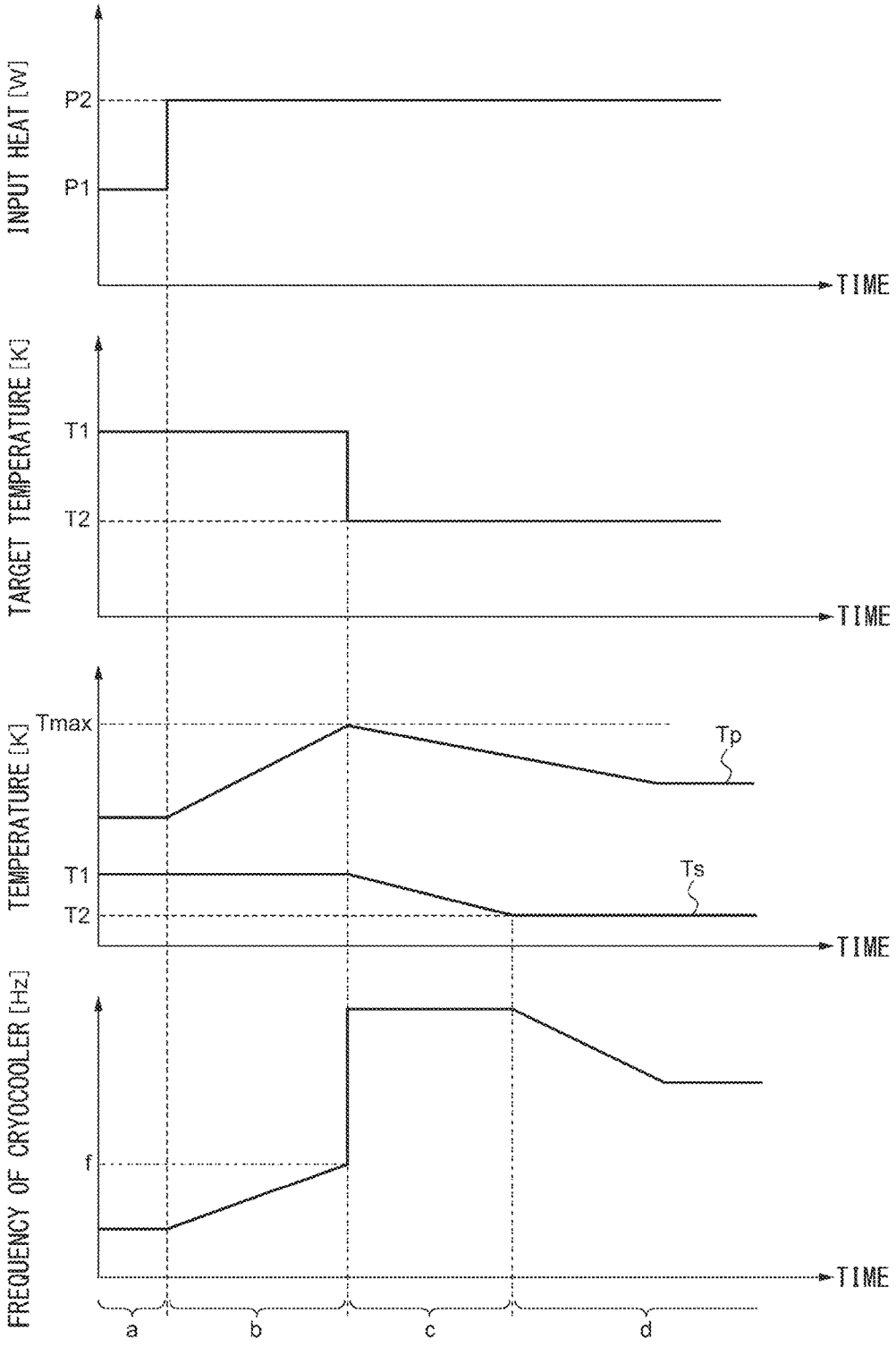
FIG. 4 is a view showing an operation of the cold trap according to the embodiment of the present invention.

FIG. 4 is a view showing the operation of the cold trap 14 according to the embodiment of the present invention. FIG. 4 shows the input heat with respect to the cold panel 22, the target temperature of the cooling stage 26, the measured temperature of the stage temperature sensor 42, and a temporal change of the operating frequency of the cryocooler inverter 118. In addition, the measured temperature of the stage temperature sensor 42 and the temperature of the cold panel 22 are shown.

As shown in FIG. 4, the cooling stage 26 is cooled so as to reach the first target stage temperature T1 (period a). The cold panel 22 receives the first input heat P1. The input heat with respect to the cold panel 22 may be smaller than the first input heat P1.

The input heat with respect to the cold panel 22 is increased due to vacuum processing in the vacuum vessel 12 (period b). As result, the cold panel 22 receives the second input heat. The input heat with respect to the cold panel 22 may be greater than the first input heat P1 and be smaller than the second input heat P2. The temperature Tp of the cold panel increases according to the increase of the input heat with respect to the cold panel 22. In addition, the operating frequency of the cryocooler inverter 118 also increases to maintain the cooling stage 26 at the first target stage temperature T1 according to the increase of the input heat with respect to the cold panel 22. In this way, the operating frequency reaches the operating frequency threshold value f. In this case, the temperature Tp of the cold panel also reaches the vicinity of a cold panel upper limit temperature Tmax.

Accordingly, the target temperature of the cooling stage 26 decreases so as to reach the second target stage temperature T2 (period c). The operating frequency of the cryocooler inverter 118 increases so as to reach the maximum frequency along with the decrease of the target temperature. The temperature Ts of the cooling stage 26 and the temperature Tp of the cold panel decrease. If the temperature Ts of the cooling stage 26 decreases so as to reach the second target stage temperature T2, the operating frequency of the cryocooler inverter 118 decreases (period d).

In this way, the cold trap 14 indirectly estimates the increase of the input heat with respect to the cold panel 22 from the operating frequency of the cryocooler 24, and can adjust the target temperature of the cooling stage 26 based on the increase of the input heat. Accordingly, the cold trap 14 can continuously cool the cold panel 22 so as to reach a temperature lower than the cold panel upper limit temperature Tmax.

Hereinbefore, the embodiment of the present invention is described. However, the present invention is not limited to the embodiment, various design changes are possible, various modification examples are possible, and a person skilled in the art understands that the modification examples are within the scope of the present invention.

As shown in FIG. 1, the cryocooler 24 may include an output variable heater 48 which is mounted on the cooling stage 26. The stage temperature control unit 110 may include a heater output determination unit which determines the output of the heater 48 which is a function of a deviation between the temperatures of the cooling stage 26 measured by the stage temperature sensor 42 and the target temperature. The control input threshold value may be a heat output threshold value which is predetermined based on a correlation between the output of the heater 48 and the temperature of the cold panel generated when the cold panel 22 receives the second input heat in the case where the first target stage temperature is selected. The input heat estimation unit 112 may determine whether or not the output of the heater 48 is smaller than the heater output threshold value. The target temperature adjustment unit 114 may select the second target stage temperature when the output of the heater 48 is smaller than the heater output threshold value.

When the heater 48 is controlled, the cryocooler frequency determination unit 116 and the cryocooler inverter 118 may not be provided in the stage temperature control unit 110. In this case, the cryocooler motor 38 is operated at a constant frequency. Alternatively, the stage temperature control unit 110 may control both the cryocooler motor 38 and the heater 48.

Figure 5:
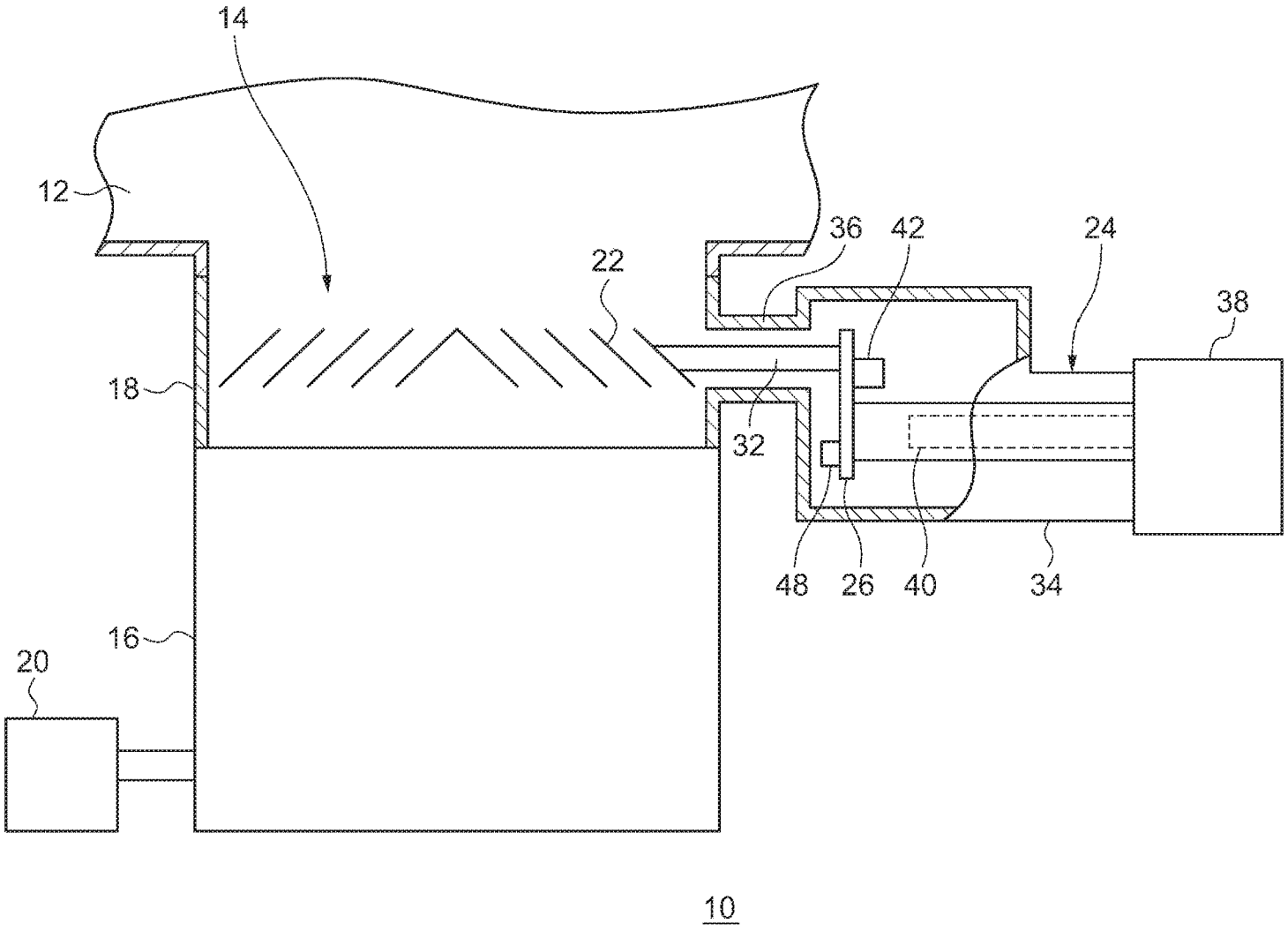
FIG. 5 is a sectional view schematically showing a vacuum exhaust device according to another embodiment of the present invention.

As shown in FIG. 5, the cold panel 22 may be disposed inside the exhaust duct 18 through which the vacuum vessel 12 is connected to the main vacuum pump 16. The cold panel 22 may be a louver. The cold panel 22 may be completely accommodated in the exhaust duct 18.

Figure 6:
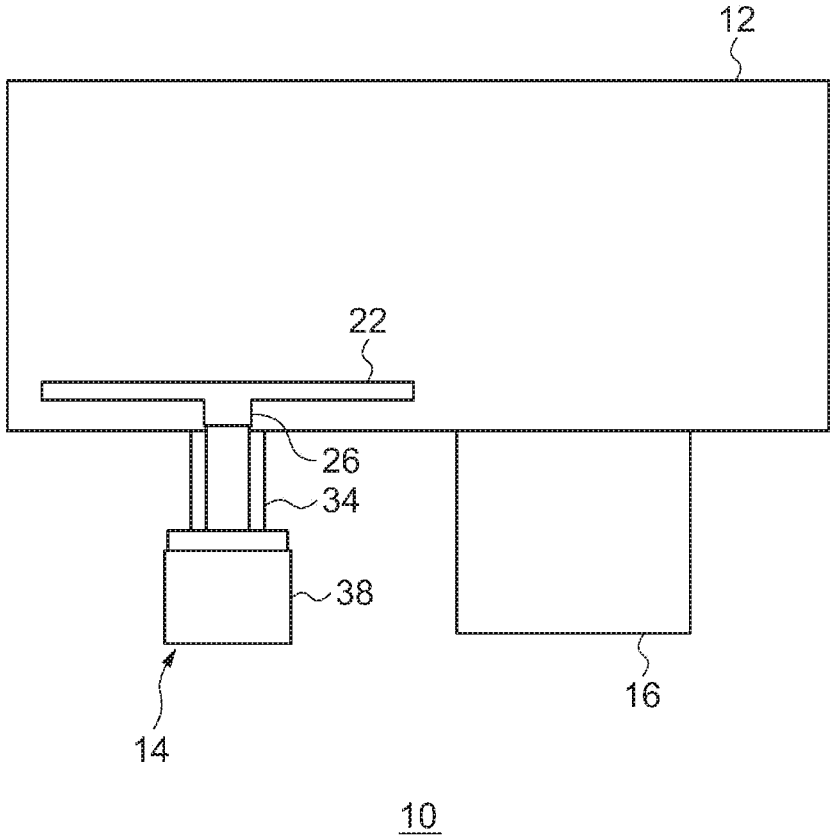
FIG. 6 is a sectional view schematically showing a vacuum exhaust device according to still another embodiment of the present invention.

As shown in FIG. 6, the cold panel 22 may not be disposed inside the exhaust duct 18, and may be disposed inside the vacuum vessel 12. The cold panel 22 may be disposed along a wall portion of the vacuum vessel 12.

In addition, in an embodiment, the target temperature adjustment unit 114 returns the target temperature of the cooling stage 26 from the target temperature corresponding to the increase of the input heat to a general target temperature. When a predetermined time elapses after the first target stage temperature is switched to the second target stage temperature, the target temperature adjustment unit 114 may change the target temperature of the cooling stage 26 from the second target stage temperature to the first target stage temperature again.

Alternatively, when the magnitude relation between the control input with respect to the cryocooler 24 and the second control input threshold value is inverted when the second target stage temperature is selected, the input heat estimation unit 112 may estimate a decrease of the input heat with respect to the cold panel 22 from the second input heat to the first input heat. The second control input threshold value may be equal to the above-described first control input threshold value, or may be different from the first control input threshold value. The target temperature adjustment unit 114 may be configured so as to increase the target temperature of the cooling stage 26 based on the decrease of the input heat which is estimated by the input heat estimation unit 112. The target temperature adjustment unit 114 may select the first target stage temperature again when the decrease of the input heat is estimated.

In addition, in an embodiment, the target temperature adjustment unit 114 may select the target temperature, which is used by the stage temperature control unit 110, from three or more predetermined target temperatures.

The cryocooler 24 is not limited to the GM cryocooler. In an embodiment, the cryocooler 24 may be other cryocoolers such as a pulse tube cryocooler or Stirling cryocooler.

It should be understood that the invention is not limited to the above-described embodiment, and may be modified into various forms on the basis of the concept of the invention. Additionally, the modifications are included in the scope of the invention.

What is claimed is:

1. A cold trap which evacuates a vacuum vessel having a main vacuum pump comprising:

a cold panel which is disposed inside an exhaust duct which connects the vacuum vessel to the main vacuum pump or is disposed inside the vacuum vessel;

a single-stage cryocooler which includes a cooling stage which is structurally connected to the cold panel and is thermally coupled to the cold panel;

a stage temperature controller which determines a control input to the single-stage cryocooler so as to cool the cooling stage to a target temperature;

an input heat estimation controller which estimates an increase of an input heat into the cold panel based on the control input to the single-stage cryocooler determined by the stage temperature controller;

a target temperature adjustment controller which decreases the target temperature based on the increase of the input heat estimated by the input heat estimation controller; and memory which stores a first target stage temperature, a second target stage temperature which is lower than the first target stage temperature, and a control input threshold value corresponding to a cold panel upper limit temperature, wherein the first target stage temperature is predetermined such that the cold panel is cooled to reach a first panel temperature lower than the cold panel upper limit temperature when the cold panel receives first input heat, wherein the second target stage temperature is predetermined such that the cold panel is cooled to reach a second panel temperature lower than the cold panel upper limit temperature when the cold panel receives second input heat greater than the first input heat, wherein the control input threshold value is predetermined based on a correlation between the control input and a temperature of the cold panel generated when the cold panel receives the second input heat in a case where the target temperature adjustment controller selects the first target stage temperature, wherein when a magnitude relation between the control input and the control input threshold value is inverted in a case where the first target stage temperature is selected, the input heat estimation controller estimates an increase of the input heat into the cold panel based on the first input heat to the second input heat, and wherein when the increase of the input heat is estimated, the target temperature adjustment controller selects the second target stage temperature.

2. The cold trap according to claim 1, wherein the single-stage cryocooler includes a stage temperature sensor which measures a temperature of the cooling stage, and a cryocooler motor which drives the single-stage cryocooler, wherein the stage temperature controller includes a cryocooler frequency determination controller which determines an operating frequency of the single-stage cryocooler which is a function of a deviation between the temperature of the cooling stage measured by the stage temperature sensor and the target temperature, and a cryocooler inverter which controls the cryocooler motor at this operating frequency, wherein the control input threshold value is an operating frequency threshold value which is predetermined based on a correlation between the operating frequency and the temperature of the cold panel generated when the cold panel receives the second input heat in a case where the first target stage temperature is selected, wherein the input heat estimation controller determines whether or not the operating frequency is greater than the operating frequency threshold value, and wherein the target temperature adjustment controller selects the second target stage temperature when the operating frequency is greater than the operating frequency threshold value.

3. The cold trap according to claim 1, wherein the single-stage cryocooler includes a stage temperature sensor which measures a temperature of the cooling stage, and a heater which is mounted on the cooling stage, wherein the stage temperature controller determines an output of the heater which is a function of a deviation between the temperature of the cooling stage measured by the stage temperature sensor and the target temperature, wherein the control input threshold value is a heater output threshold value which is predetermined based on a correlation between the output of the heater and the temperature of the cold panel generated when the cold panel receives the second input heat in a case where the first target stage temperature is selected, wherein the input heat estimation controller determines whether or not the output of the heater is smaller than the heater output threshold value, and wherein the target temperature adjustment controller selects the second target stage temperature when the output of the heater is smaller than the heater output threshold value.

4. A cold trap which evacuates a vacuum vessel having a main vacuum pump comprising:

a cold panel which is disposed inside an exhaust duct which connects the vacuum vessel to the main vacuum pump or is disposed inside the vacuum vessel;

a single-stage cryocooler which includes a cooling stage which is structurally connected to the cold panel and is thermally coupled to the cold panel;

a stage temperature controller which determines a control input to the single-stage cryocooler so as to cool the cooling stage to a target temperature;

an input heat estimation controller which estimates an increase of an input heat into the cold panel based on the control input to the single-stage cryocooler determined by the stage temperature controller; and a target temperature adjustment controller which decreases the target temperature based on the increase of the input heat estimated by the input heat estimation controller, wherein the cold panel includes a first panel portion which is disposed inside the exhaust duct, and a second panel portion which extends from the first panel portion and is disposed inside the vacuum vessel, wherein the first panel portion is directly fixed to the cooling stage, or is fixed to the cooling stage via a heat transfer member, and wherein the second panel portion is thermally coupled to the cooing stage via the first panel portion.

* * * * *